US009834994B2

(12) United States Patent
Crowley et al.

(10) Patent No.: US 9,834,994 B2
(45) Date of Patent: Dec. 5, 2017

(54) APPARATUS AND METHOD FOR CONTROLLING A PART OF A DOWNHOLE ASSEMBLY, AND A DOWNHOLE ASSEMBLY

(71) Applicant: Smart Stabilizer Systems Limited, Ashchurch, Tewkesbury (GB)

(72) Inventors: Daniel Brendan Crowley, Tewkesbury (GB); Colin Walker, Derbyshire (GB)

( * ) Notice: Subject to any disclaimer, the term of this patent is extended or adjusted under 35 U.S.C. 154(b) by 246 days.

(21) Appl. No.: 14/406,460

(22) PCT Filed: Jun. 11, 2013

(86) PCT No.: PCT/GB2013/051536
§ 371 (c)(1),
(2) Date: Dec. 8, 2014

(87) PCT Pub. No.: WO2013/186554
PCT Pub. Date: Dec. 19, 2013

(65) Prior Publication Data

US 2015/0159437 A1 Jun. 11, 2015

(30) Foreign Application Priority Data

Jun. 12, 2012 (GB) ..... 1210340.4

(51) Int. Cl.
*E21B 7/06* (2006.01)
*E21B 4/02* (2006.01)
(Continued)

(52) U.S. Cl.
CPC ..... *E21B 7/068* (2013.01); *E21B 4/02* (2013.01); *E21B 17/1014* (2013.01); *E21B 21/103* (2013.01); *E21B 34/10* (2013.01)

(58) Field of Classification Search
CPC .... E21B 17/1014; E21B 21/103; E21B 34/10; E21B 4/02; E21B 7/068
(Continued)

(56) References Cited

U.S. PATENT DOCUMENTS 3,261,318 A 7/1966 Jones et al.
3,841,420 A 10/1974 Russell
(Continued)

FOREIGN PATENT DOCUMENTS

EP 1024245 A3 8/2000
GB 2435060 A 8/2007
(Continued)

OTHER PUBLICATIONS

International Preliminary Report on Patentability received in corresponding International Application No. PCT/GB2013/051536, dated Nov. 10, 2014.
(Continued)

*Primary Examiner* — Taras P Bemko
(74) *Attorney, Agent, or Firm* — Blank Rome, LLP

(57) ABSTRACT

This invention relates to an apparatus and method for controlling a part of a downhole assembly, and to the downhole assembly. The downhole assembly may include a steering mechanism adapted to steer a drill bit in a chosen direction, and the steering mechanism may be the part of the downhole assembly which is controlled by the apparatus. The downhole assembly includes a drill bit and a motor, the motor having a stator and a rotor, the rotor being driven to rotate relative to the stator by the passage of a drilling fluid along a drilling fluid path between the rotor and the stator. The motor has a conduit through which the drilling fluid can pass, the conduit being separate from the drilling fluid path, and the apparatus has a valve to control the flow of drilling fluid through the conduit. The invention provides a robust and reliable means of delivering high pressure drilling fluid downstream of the motor.

16 Claims, 6 Drawing Sheets

(51) Int. Cl.
*E21B 21/10* (2006.01)
*E21B 17/10* (2006.01)
*E21B 34/10* (2006.01)

(58) Field of Classification Search
USPC ..... 175/45, 73
See application file for complete search history.

(56) References Cited

U.S. PATENT DOCUMENTS

| | | | |
|---|---|---|---|
| 4,416,339 | A | 11/1983 | Baker et al. |
| 7,766,098 | B2 | 8/2010 | Farley |
| 2004/0104051 | A1 | 6/2004 | Moriarty et al. |
| 2005/0173157 | A1 | 8/2005 | Ravensbergen et al. |
| 2006/0243493 | A1 | 11/2006 | El-Rayes et al. |
| 2010/0116551 | A1 | 5/2010 | Southard |
| 2012/0145458 | A1* | 6/2012 | Downton ..... E04D 13/165 175/50 |

FOREIGN PATENT DOCUMENTS

| | | | |
|---|---|---|---|
| GB | 2440024 | A | 1/2008 |
| GB | 2450498 | A | 12/2008 |
| WO | 2012138383 | A2 | 10/2012 |

OTHER PUBLICATIONS

International Search Report received in corresponding International Application No. PCT/GB2013/051536, dated Apr. 17, 2014.

* cited by examiner

APPARATUS AND METHOD FOR CONTROLLING A PART OF A DOWNHOLE ASSEMBLY, AND A DOWNHOLE ASSEMBLY

FIELD OF THE INVENTION

This invention relates to an apparatus and method for controlling a part of a downhole assembly, and to a downhole assembly. The invention is likely to find its greatest utility in controlling the steering mechanism of a downhole assembly whereby to steer a drill bit in a chosen direction, and most of the following description will relate to steering applications. It will be understood, however, that the apparatus and method may be used to control other parts of the downhole assembly.

BACKGROUND TO THE INVENTION

When drilling for oil and gas, it is desirable to maintain maximum control over the drilling operation, notwithstanding that the drilling operation might be several kilometers below the Earth's surface. Steerable drill bits, which can achieve directional drilling, are in widespread use, and are often required to drill complex borehole trajectories requiring accurate control of the path of the drill bit during the drilling operation.

Directional drilling is complicated by the necessity to operate the steerable drill bit within harsh borehole conditions. The steering mechanism is typically disposed near the drill bit. In order to obtain the desired real-time directional control, it is preferred to operate the steering mechanism remotely from the surface of the Earth. Furthermore, the steering mechanism must be operated to maintain the desired path and direction regardless of its depth within the borehole and whilst maintaining practical drilling speeds. Finally, the steering mechanism must reliably operate under exceptional heat, pressure and vibration conditions that will typically be encountered during the drilling operation.

Many types of steering mechanism are known: A common type of steering mechanism comprises a motor disposed in a housing with a longitudinal axis which is offset, tilted or otherwise displaced from the axis of the borehole. The motor can be of a variety of types including electric and hydraulic. Hydraulic motors which operate by way of the circulating drilling fluid are commonly known as a "mud" motors. The drill bit is attached to the output shaft of the motor, and is rotated by the action of the motor. The axially offset motor housing, commonly referred to as a bent subsection or "bent sub", provides axial displacement that can be used to change the trajectory of the borehole. By rotating the drill bit with the motor and simultaneously rotating the motor housing with the drill string, the orientation of the housing offset continuously changes and the path of the advancing borehole is maintained substantially parallel to the axis of the drill string. By rotating the drill bit with the motor only, the path of the borehole is deviated from the axis of the non-rotating drill string in the direction of the offset of the bent sub. By alternating these two methodologies of drill bit rotation, the path of the borehole can be controlled. A more detailed description of directional drilling using the bent sub concept is disclosed in U.S. Pat. Nos. 3,260,318, and 3,841,420.

UK patent applications 2 435 060 and 2 440 024 also describe methods of steering a drill bit by way of the bent housing of a downhole motor. The drill string is rotating and there is a rotatable connection between the drill string and the housing of the downhole motor. A clutch mechanism is provided within the rotatable connection, the clutch mechanism controlling the orientation of the housing and consequently the orientation of the bend.

Another method for steering a drill bit is to utilise a steering mechanism such as that described in our published European patent 1 024 245. That steering mechanism allows the drill bit to be moved in any chosen direction, i.e. the direction (and degree) of curvature of the borehole can be determined during the drilling operation, and as a result of the measured drilling conditions at a particular borehole depth. Another mechanism which can cause a (variable) lateral offset, and thereby deviate the drill bit in a desired direction, and by a desired amount, is disclosed in U.S. Pat. No. 4,416,339.

Directional drilling applications require the drill string, or parts of the downhole assembly, to articulate and/or be flexible so as to pass along the curved borehole.

U.S. Pat. No. 7,766,098 describes a mechanism and method for steering a drill bit by periodically varying the rotational rate of the drill bit. This patent takes advantage of the fact that the rate at which the drill bit removes borehole material is dependent upon its rate of rotation. By varying the rate of rotation of the drill bit cyclically during each 360° rotation of the drill string, the drill bit can be caused to remove more material from one side of the borehole than the other, whereby to cause the drill bit to deviate from a linear path. The cyclical operation of a steering mechanism is a feature of many steering tools used with rotating drill strings, including that of the aforementioned EP 1 024 245.

SUMMARY OF THE INVENTION

The present invention seeks to provide an apparatus and method for controlling a part of a downhole assembly. The invention seeks to provide an apparatus which is mechanically simple and robust and thereby capable of withstanding the harsh environments encountered by downhole tools.

According to the invention there is provided an apparatus for controlling a part of a downhole assembly, the downhole assembly including a drill bit and a motor, the motor having a stator and a rotor, the rotor being driven to rotate relative to the stator by way of a drilling fluid, the rotor being connected to the drill bit, the motor having a conduit through which the drilling fluid can pass, the apparatus having a valve to control the flow of drilling fluid through the motor.

In a typical downhole motor the rotor is driven to rotate by way of the drilling fluid flowing between the rotor and the stator. In a positive displacement motor such as a mud motor, the stator and rotor together define a series of closed chambers which move from the "uphole" end of the motor to the "downhole" end of the motor as the rotor rotates. In a vane motor a series of vanes span the distance between a rotor shaft and the stator and define a number of closed chambers, the vanes being driven to rotate as the drilling fluid is pumped through the motor.

The energy required to drive the rotor (and the attached drill bit) to rotate is extracted from the drilling fluid as a pressure drop across the motor. Thus, the pressure of the drilling fluid above the motor is significantly greater than the pressure of the drilling fluid below the motor. The pressure within the drilling fluid drops further as the drilling fluid passes the drill bit, the fluid entering the annulus surrounding the downhole assembly and flowing back to the surface (together with entrained drill cuttings).

Providing a conduit though the motor, and permitting drilling fluid to pass through the conduit, provides a source of high pressure fluid within the downhole assembly below the motor, for example between the motor and the drill bit. Alternatively stated, the present invention transfers some of the high pressure drilling fluid from uphole of the motor to downhole of the motor. The part of the downhole assembly which is controlled by the apparatus is therefore ideally located below the motor. Specifically, because the drilling fluid which passes through the conduit effectively bypasses the motor the inventors have appreciated that the drilling fluid can undertake useful work adjacent to the drill bit. The invention avoids the requirement to provide a separate source of high pressure hydraulic fluid adjacent to the drill bit.

For a steering mechanism in particular, the presence of high pressure fluid immediately adjacent to the drill bit is highly advantageous, as the fluid can be used to control a steering mechanism much closer to the drill bit than was previously available. It is recognised that the path of the drill bit can be controlled more effectively and accurately the closer the steering mechanism is to the drill bit.

Preferably, the conduit is located within the rotor of the motor. In a typical downhole drilling assembly the drilling fluid is pumped down the centre of the drill string and flows around the rotor. Providing a conduit through the rotor is expected to be less mechanically complex than providing a conduit through another part of the motor (such as the stator for example), or providing dedicated piping to pass the fluid across the motor.

Desirably, the motor is a positive displacement motor, suitably a Moineau motor (or "mud motor"). The pressure drop across a mud motor is significant, for example several million Pascals (several hundreds of psi) in a typical drilling application.

In embodiments utilising a Moineau motor, the motor has an output shaft (and may in certain designs also have an input shaft). To cater for the eccentric motion of the rotor the output shaft (and input shaft if present) is flexible.

In preferred embodiments of the present invention the motor has an input shaft as well as an output shaft. One end of the input shaft, and one end of the output shaft, are connected to the rotor, the other ends of the shafts being mounted in respective bearing blocks. Preferably, the input shaft and the output shaft each have a conduit therethrough, which communicate with the conduit in the rotor. The valve is desirably mounted in the bearing block for the input shaft. The valve is therefore not required to undergo eccentric motion.

The conduit in the output shaft is ideally connected to an outlet conduit within the bearing block of the output shaft. The outlet conduit can deliver the drilling fluid to the location of use.

The bearing blocks are preferably carbide-to-carbide journal bearings which are lubricated by the drilling fluid. This is a typical arrangement for a Moineau motor, in which a bearing block also acts as a flow restrictor, i.e. the differential pressure across the bearing block allows a small proportion of the drilling fluid to pass through the bearing, thereby lubricating it.

Preferably, the invention is utilised to control a steering mechanism, and the outlet conduit is connected to a cylinder within which is located a piston of the steering mechanism. The piston may be connected to an offsetting component adapted to drive the drill bit away from the centreline of the borehole.

The piston can move laterally and can cause a steering pad or the like also to move laterally. Alternatively, the piston can move longitudinally and the longitudinal movement can be converted to lateral movement of the offsetting component by way of cooperating elements which are angled relative to the longitudinal axis of the borehole.

BRIEF DESCRIPTION OF THE PREFERRED EMBODIMENTS

The invention will now be described in more detail, by way of example, with reference to the accompanying drawings, in which.

DETAILED DESCRIPTION

Figure 1:
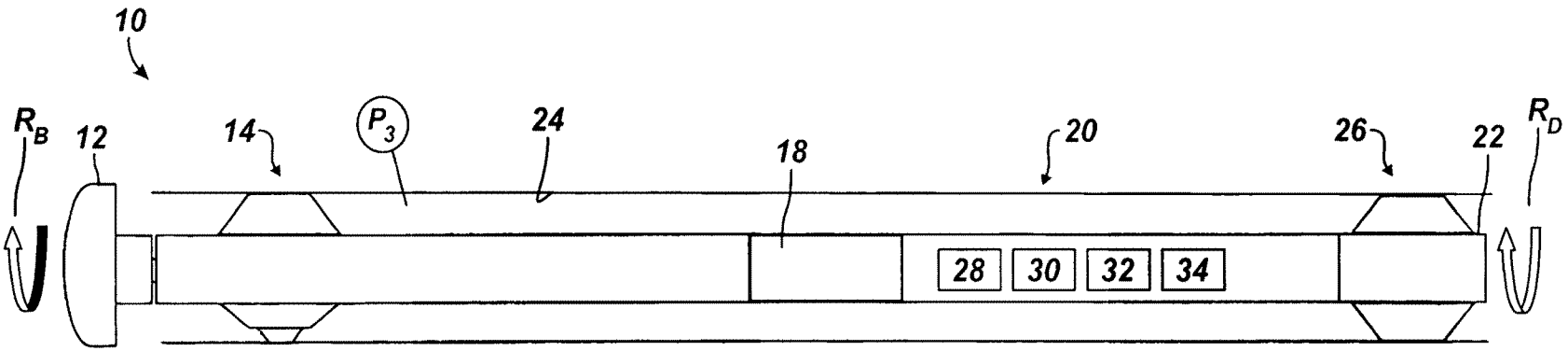
FIG. 1 is a schematic representation of a downhole assembly incorporating an embodiment of the present invention to control a steering mechanism, the steering mechanism being in a condition which does not deviate the drill bit.

As shown in FIG. 1, the downhole assembly 10 comprises a drill bit 12, a near-bit stabilizer 14, a motor 18 and a control section 20. The downhole assembly 10 is connected to the downhole or bottom end of a drill string 22, the other end of which is connected to equipment (not shown) at the surface of the Earth. It is preferable that the drill string is rotated by the surface equipment.

Importantly, it is not necessary in this embodiment to provide a flexible or articulating joint within the downhole assembly, as the componentry is sufficiently flexible to allow the necessary steering deflection.

In known fashion, the diameter of the downhole assembly 10 and the diameter of the drill string 22 are smaller than the diameter of the borehole 24 which is drilled by the drill bit 12. Drilling fluid or mud is pumped by the surface equipment through the drill string 22 and downhole assembly 10, including the drill bit 12, and returns to the surface (together with entrained drill cuttings) by way of the annular gap surrounding the downhole assembly 10 and the drill string 22. One of the drill string stabilizers 26 which serve to centralize the drill string within the borehole 24 is shown in FIG. 1.

The near-bit stabilizer 14 also serves to centralize the downhole assembly 10 within the borehole, but importantly in this embodiment also acts to steer the drill bit by causing the drill bit 12 to deviate from the centreline of the borehole, as explained below.

In common with many downhole assemblies, the control section 20 comprises a sensor section 28, a power supply section 30, an electronics section 32, and a downhole telemetry section 34. The sensor section 28 comprises directional sensors such as magnetometers and inclinometers that can be used to indicate the orientation of the downhole assembly 10 within the borehole 24. This information, in turn, is used in defining the borehole path. The sensor section 28 can also comprise other sensors used in Measurement-While-Drilling (MWD) and Logging-While-Drilling (LWD) operations including, but not limited to, sensors responsive to gamma radiation, neutron radiation and electromagnetic fields.

The electronics section 32 comprises electronic circuitry to operate and control other elements within the downhole assembly 10. The electronics section 32 preferably comprises a memory unit for storing directional drilling parameters, measurements made by the sensor section 28, and directional drilling operating systems. The electronic section 32 also preferably comprises a downhole processor to control elements comprising the downhole assembly 10 and to process various measurement and telemetry data.

Elements within the downhole assembly 10 are in communication with the surface of the Earth by way of the downhole telemetry section 34. The downhole telemetry section 32 receives and transmits data to an uphole telemetry section (not shown) which is typically located at the Earth's surface. Various types of borehole telemetry systems can be used, including mud pulse systems, mud siren systems, electromagnetic systems and acoustic systems.

The power supply section 30 supplies the electrical power necessary to operate the other elements within the downhole assembly 10. The power is typically supplied by batteries, but the batteries can be supplemented by power extracted from the drilling fluid by way of a power turbine, for example.

Figure 4:
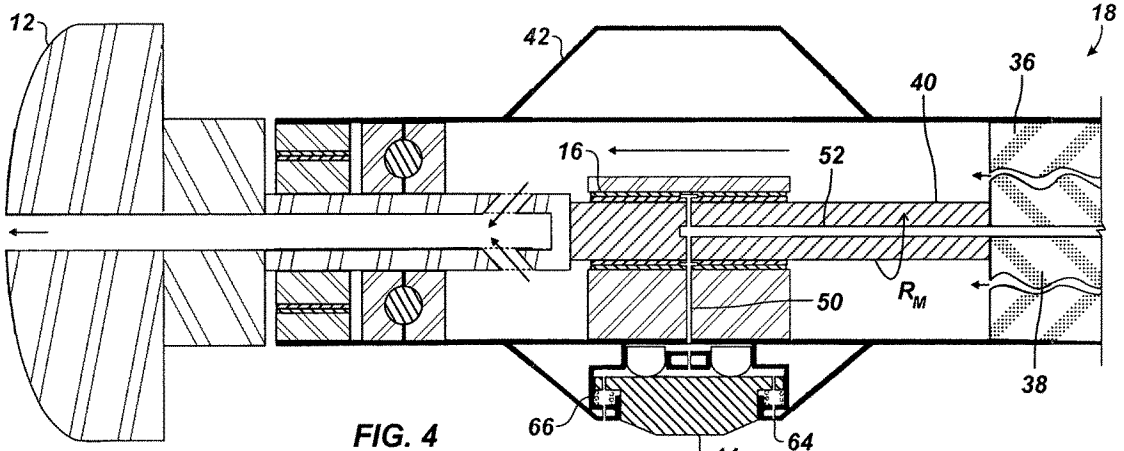
FIG. 4 is a sectional view through another part of the downhole assembly of FIG. 3, below the motor, with the valve closed.
Figure 3:
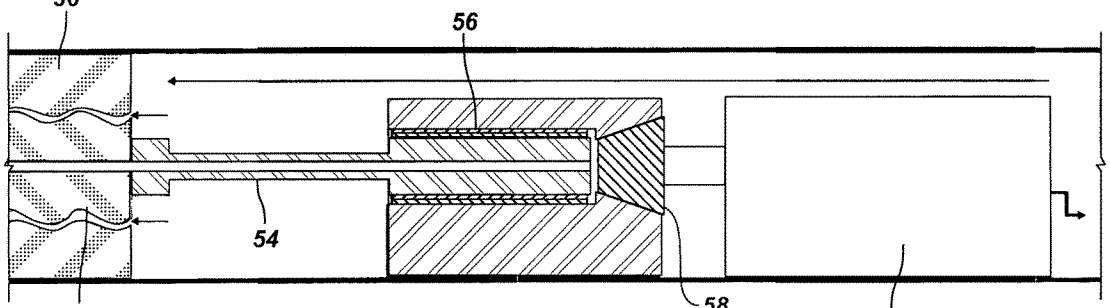
FIG. 3 is a sectional view through a part of a downhole assembly similar to that of FIGS. 1 and 2, above the motor, with the valve closed.

As explained above, the drill string 22 is rotating at a rotational rate $R_D$. In typical fashion, the drill string 22 is connected to the housing (or "stator") 36 (FIG. 3) of the motor 18. As drilling fluid is pumped through the motor 18 the rotor 38 (FIG. 3) is driven to rotate relative to the stator at a rotational rate $R_M$ (FIG. 4). The output shaft 40 of the motor 18 is connected to the drill bit 12 so that the drill bit rotation speed $R_B$ is the sum of the drill string rotation rate $R_D$ and the motor rotation rate $R_M$.

Figure 6:
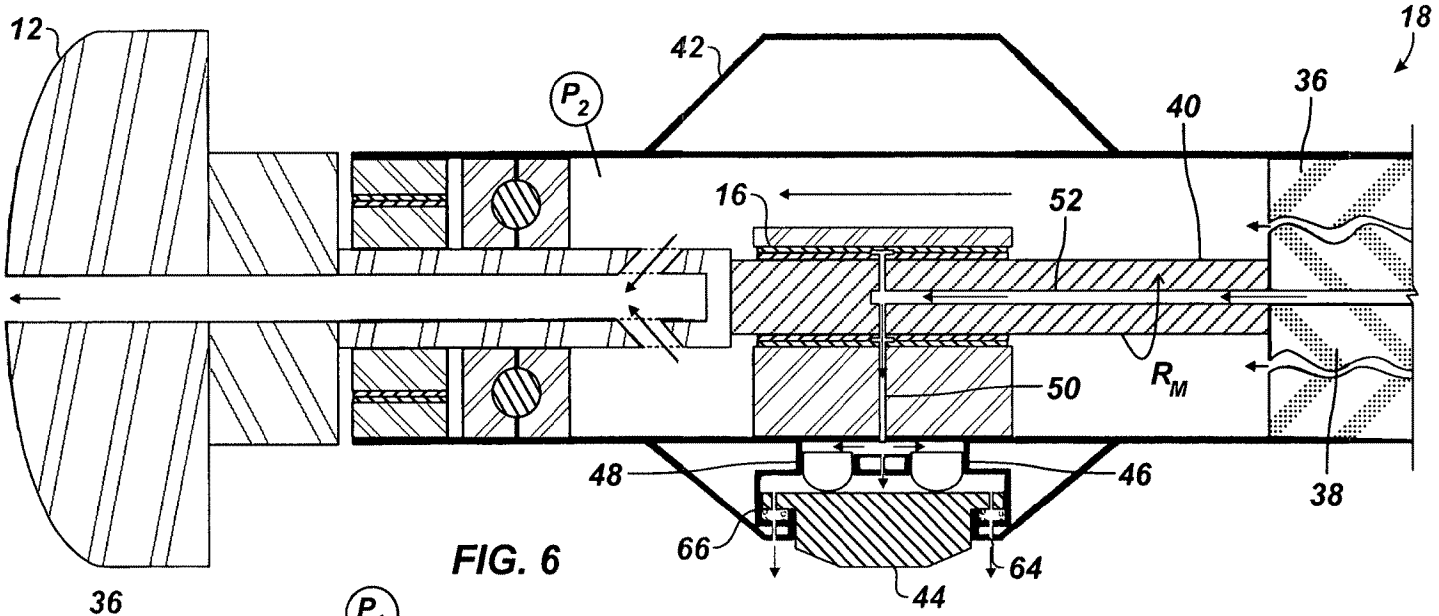
FIG. 6 is a sectional view through the part of the downhole assembly of FIG. 4, with the valve open.

The near bit stabilizer 14 has a number of (in this embodiment three) fixed blades or pads 42, and one movable blade or pad 44 (see in particular FIGS. 7,8), each of which is adapted to engage the wall of the borehole 24. As shown in FIGS. 4 and 6 the movable pad 44 is engaged by two pistons 46 which are slidable within respective cylinders 48. The cylinders 48 are connected to an outlet fluid conduit 50 which lies within the bearing block 16 of the motor output shaft 40. The outlet fluid conduit 50 is in turn connected to a longitudinal fluid conduit 52.

In this embodiment the longitudinal conduit 52 comprises a part located within the motor output shaft 40, a part within the rotor 38, a part within the motor input shaft 54, and a part within the input shaft bearing block 56. The fluid conduit terminates at valve member 58.

Figure 5:
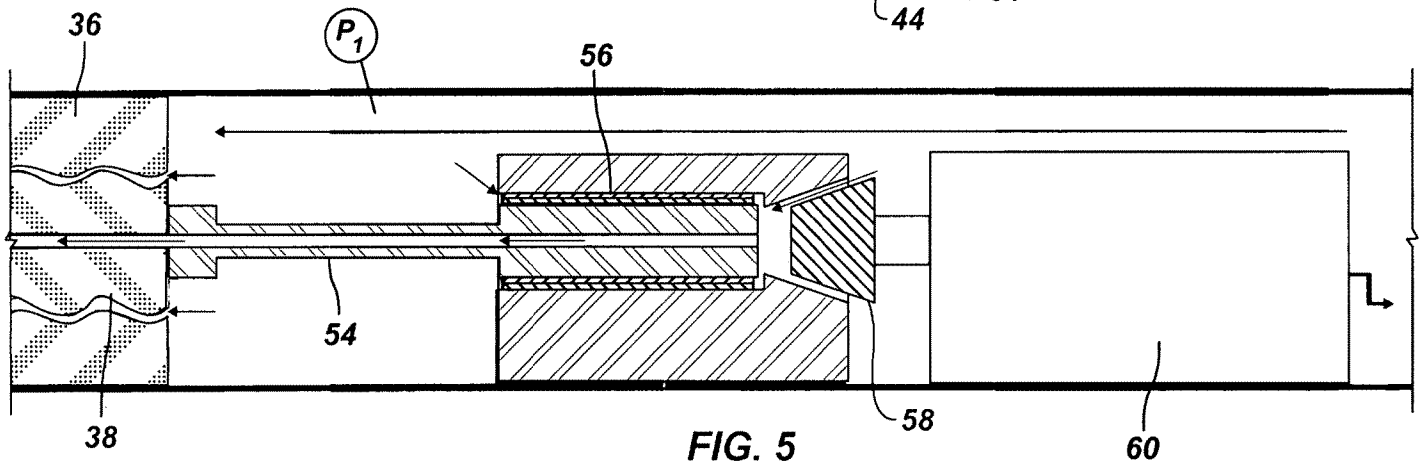
FIG. 5 is a sectional view through the part of the downhole assembly of FIG. 3, with the valve open.

Valve member 58 is controlled by actuator 60 which is connected to the components within the control section 20 (and which may be located within the control section 20). The actuator 60 is located within the path for the drilling fluid through the downhole assembly 10 (the path of the drilling fluid being shown by the arrows within the downhole assembly 10), and can control the valve member 58 to move between a closed position (FIG. 3) in which drilling fluid cannot enter the conduit 52, and an open position (FIG. 5) in which drilling fluid can enter the conduit 52.

Importantly, when the valve member 58 is open, only a small proportion of the drilling fluid enters the conduit 52, and the majority of the drilling fluid is still pumped through the motor 18. Accordingly, the opening and closing of the valve member 58 has only a small effect upon the rate of rotation of the rotor 38.

When the valve member 58 is open, drilling fluid passes through the conduit 52, through the outlet conduit 50, and into the cylinders 48. The drilling fluid can leave the cylinders 48 by way of exhaust ports 62 and 64, and flow into the annulus between the downhole assembly 10 and the borehole 24. The cross-sectional area of the conduits 52, 50 is greater than the cross-sectional area of the exhaust ports 62, 64, so that when the valve member 58 is opened the pistons 46 are driven outwardly of their cylinders 48, from the retracted condition of FIG. 4 to the extended condition of FIG. 6, which in turn drives the movable pad 44 outwardly. When the valve member 58 is closed, however, the fluid within the cylinders 48 drains by way of the exhaust ports 62 and 64, and the return springs 66 drive the movable pad 44, and thereby the pistons 46, inwardly.

It will be understood that the pressure $P_1$ within the drilling fluid adjacent to the valve member 58 is very close to that within the drill string 22. The pressure $P_1$ is considerably higher than the pressure $P_2$ below the motor 18, which in turn is significantly higher than the pressure $P_3$ (see FIG. 1) within the annulus between the downhole assembly 10 and the borehole 24.

It will be understood that, with valve 58 closed, the pressure differential $P_2$-$P_3$ would be sufficient to drive the pad 44, and it will also be understood that some of the lubricating fluid for the bearing block 16 can enter the cylinders 48 by way, of the conduit 50. However, the bearing block 16 restricts the flow rate of drilling fluid into the conduit 50 sufficiently that pressure bleeds away immediately through exhaust ports 62 and 64, and pad 44 remains retracted. A flow rate of drilling fluid into the cylinders 48 sufficient to move the pad 44 is only present when valve 58 is opened.

Figure 2:
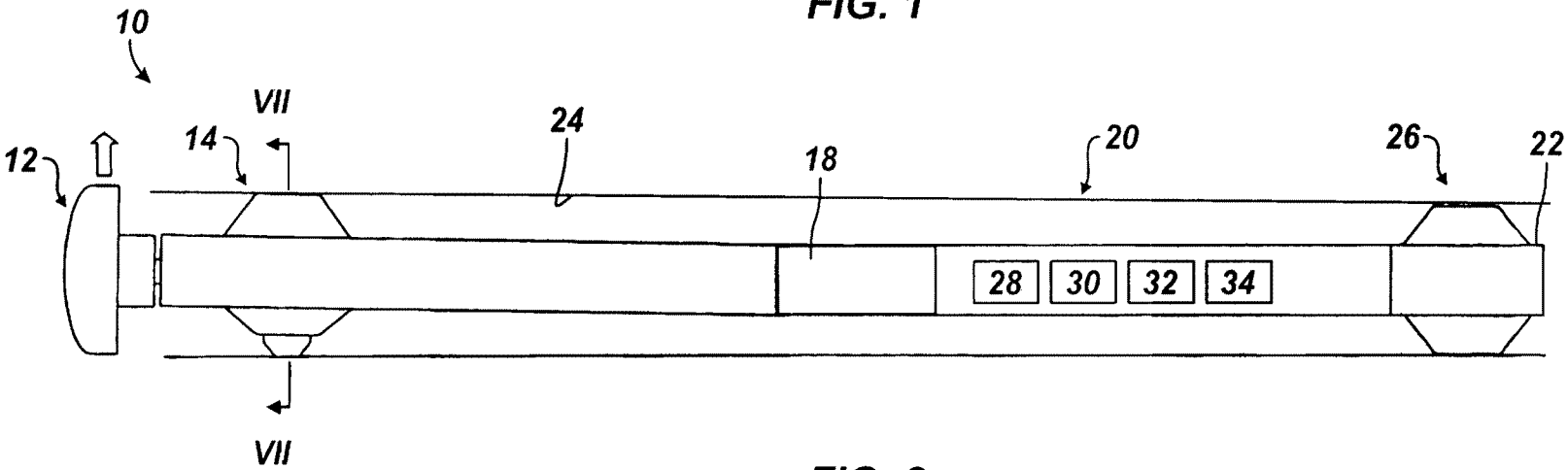
FIG. 2 is a view as FIG. 1, with the steering mechanism actuated to deviate the drill bit.
Figure 8:
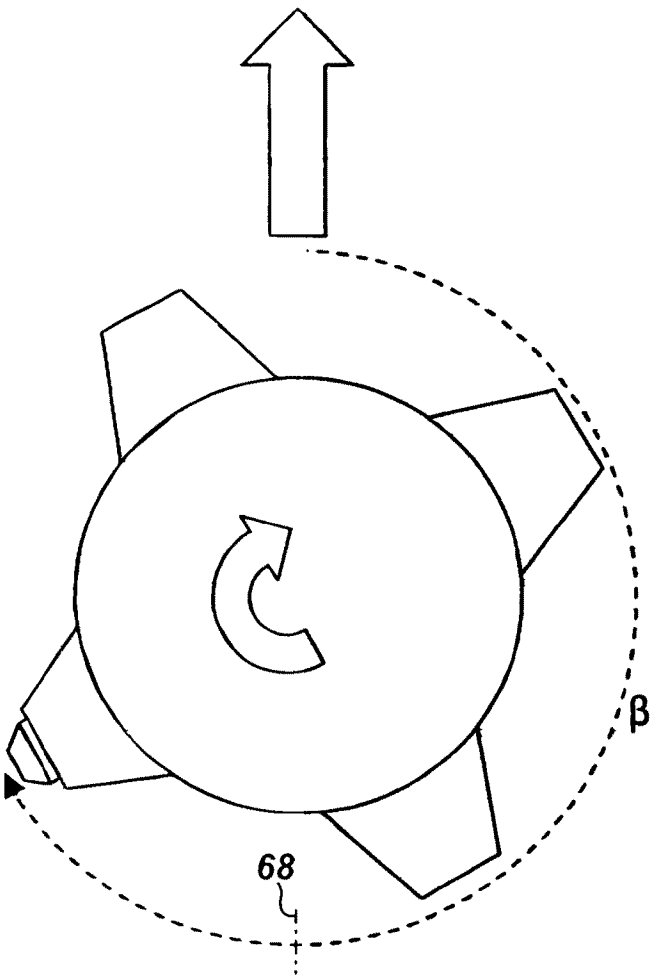
FIGS. 7 and 8 are cross-sectional views of the steering mechanism in use.
Figure 7:
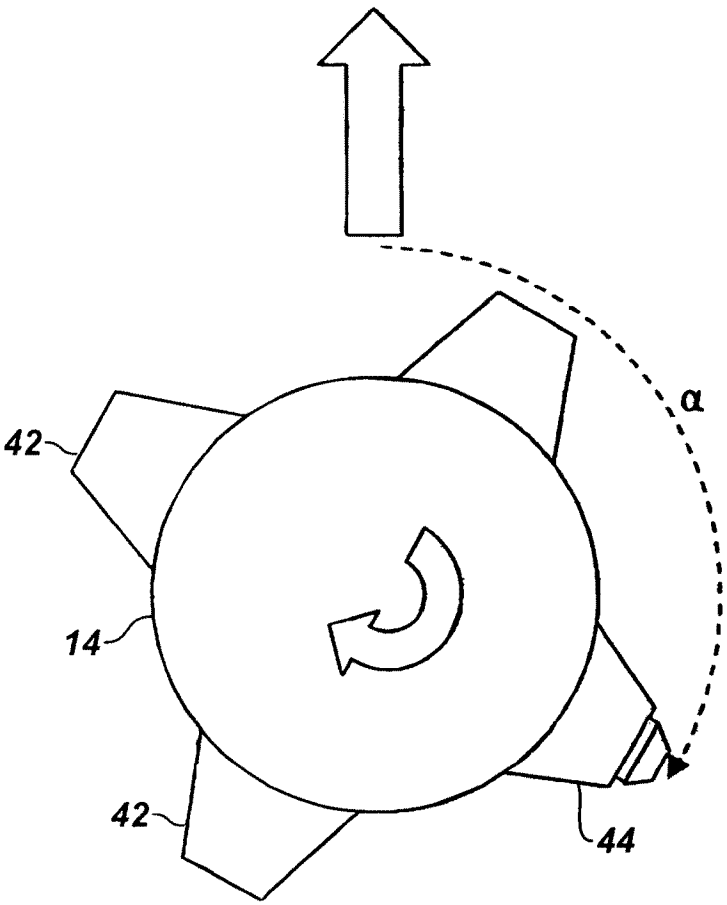

It will be understood that if the drill string 22 is rotating, the operation of the steering mechanism must be cyclical, substantially matching the period of rotation of the drill string 22. As shown in FIGS. 7 and 8 (each of which is a cross-sectional view through the near-bit stabilizer 14 of FIGS. 2 and 6), if it is desired to deviate the drill bit in a direction towards the top of the sheet, it is necessary to extend the movable pad 44 as it faces the bottom of the sheet.

It will also be understood that the near-bit stabilizer 14 rotates with the stator 36 of the motor 18, which in turn rotates with the drill string 22. The orientation of the movable pad can therefore be determined by the sensor section 28. When it is desired to deviate the borehole in a chosen direction (the direction of the arrows in FIGS. 7 and 8) the control section 20 can calculate the orientation of the diametrically opposed position 68, and instruct the valve actuator 60 to open the valve 58 accordingly. Specifically, the valve actuator 60 opens the valve 58 at a first angle $\alpha$, and closes the valve 58 at a second angle $\beta$, for each rotation of the stabilizer 14.

Since the movable pad 44 does not move instantaneously to its extended condition, it is necessary that the valve 58 opens before the pad 44 reaches the position 68, and that the valve 58 remains open for a proportion of each rotation. If desired, it can be arranged that the angles α and β are equally-spaced to either side of the position 68, but since it is likely that the movable pad 44 will extend gradually (and in particular more slowly that it will retract) it is preferable that the angle β is closer to the position 68 than is the angle α.

The duration for which the valve 58 must be open, and therefore the difference between the angles α and β, can be determined by experiment or calculation, as can the relationship between the angles α and β and the position 68.

Notwithstanding that the movable pad 44 is suitable to deviate a substantially linear downhole assembly as in the embodiment shown, it could alternatively be used with a bent housing, for example with the bent housing oriented approximately 180° from the movable pad.

The embodiment of FIGS. 9-12 is similar to that of FIGS. 4-8 in using the drilling fluid to control a steering mechanism. However, in this embodiment the steering mechanism includes an offsetting component which is controlled by elements which have cooperating surfaces 70, 72 which are angled relative to the longitudinal axis of the downhole assembly. The structure of the downhole assembly above the motor 18, and the structure of the motor 18, are identical to those of the embodiment of FIGS. 4-8, and the same reference numerals are used.

In this embodiment, the conduit 52 communicates with an outlet conduit 74 which opens into an annular cylinder 76. An annular piston 78 cooperates with the cylinder 76, the piston being having an angled surface 72 in contact with an angled collar 70. The angled collar 70 is formed as an extension of a knuckle joint 80.

A drive shaft 82 is located within the knuckle joint 80, the drive shaft terminating in respective constant velocity joints 84. The constant velocity joints 84 permit the rotation of the output shaft 40 to be communicated to the shaft 86 which is connected to the drill bit (not shown in this embodiment).

It will be understood that, as the piston 78 moves longitudinally relative to its cylinder 76, the angled surfaces 70,72 cause transverse movement of the collar, and consequent pivoting of the knuckle joint 80. The drill bit is thereby caused to deviate from a linear path.

Figure 10:
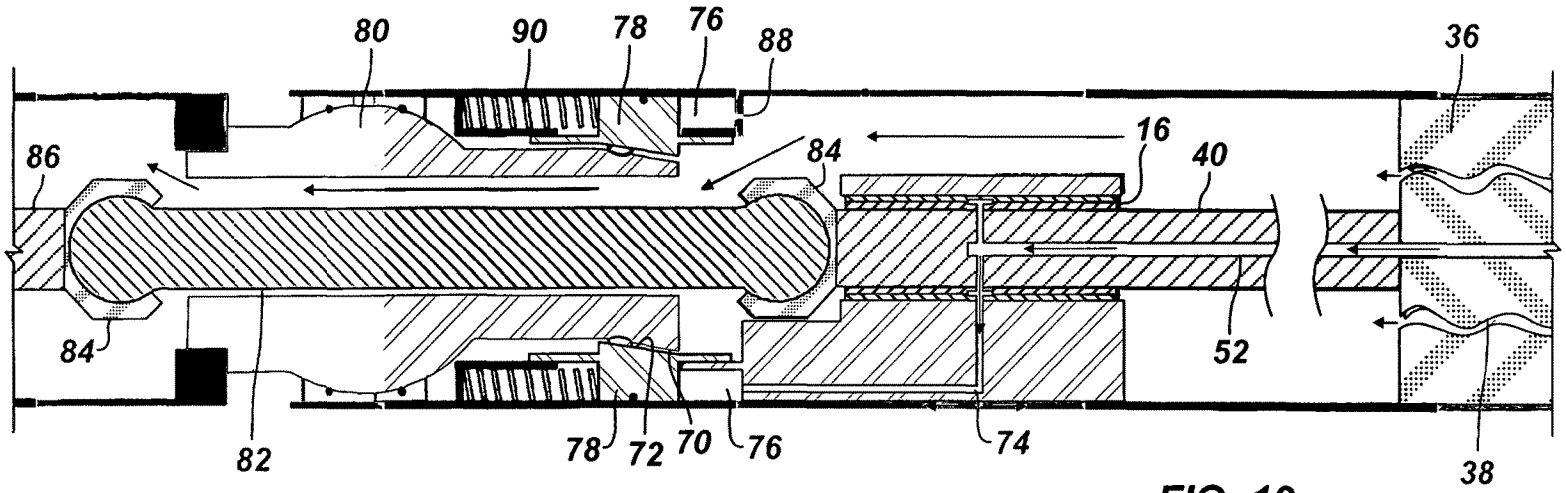
FIG. 10 is a sectional view through another part of the downhole assembly of FIG. 9, below the motor, with the valve closed.
Figure 9:
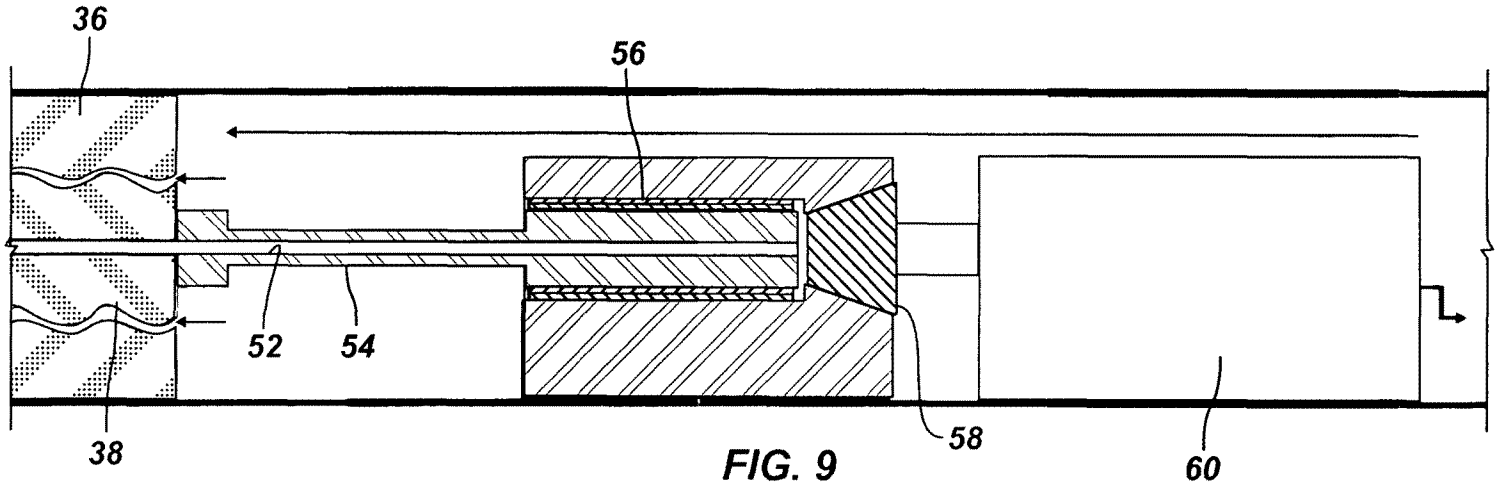
FIG. 9 is a sectional view through a part of another downhole assembly, above the motor, the assembly having an alternative steering mechanism, with the valve closed.
Figure 12:
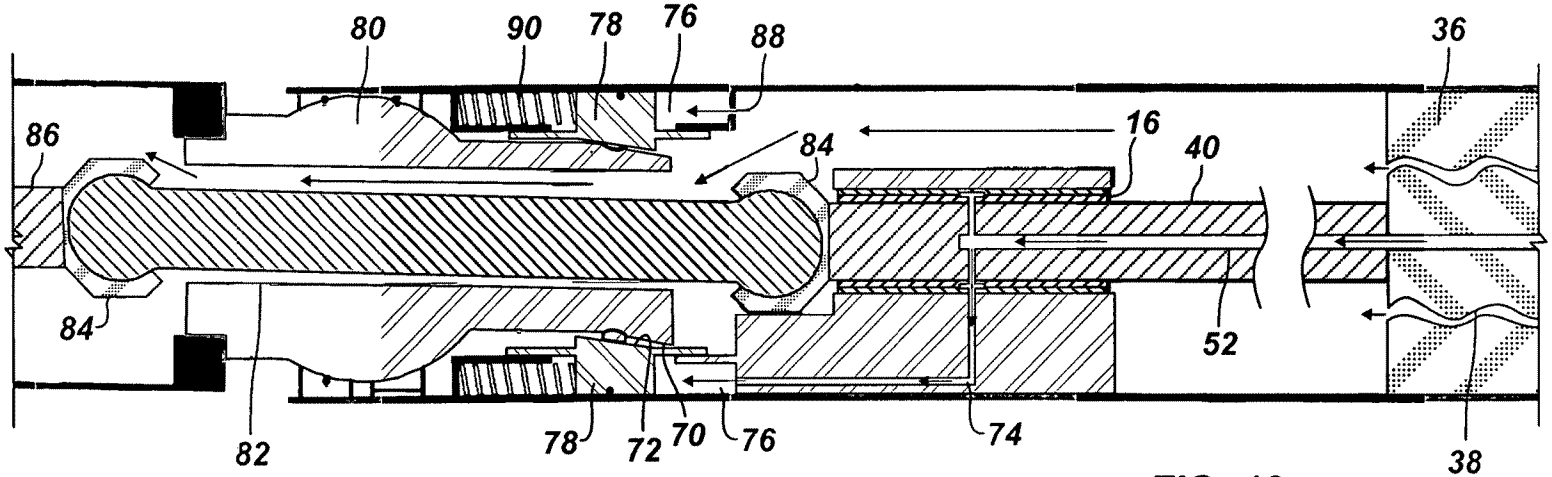
FIG. 12 is a sectional view through the part of the downhole assembly of FIG. 10, with the valve open.
Figure 11:
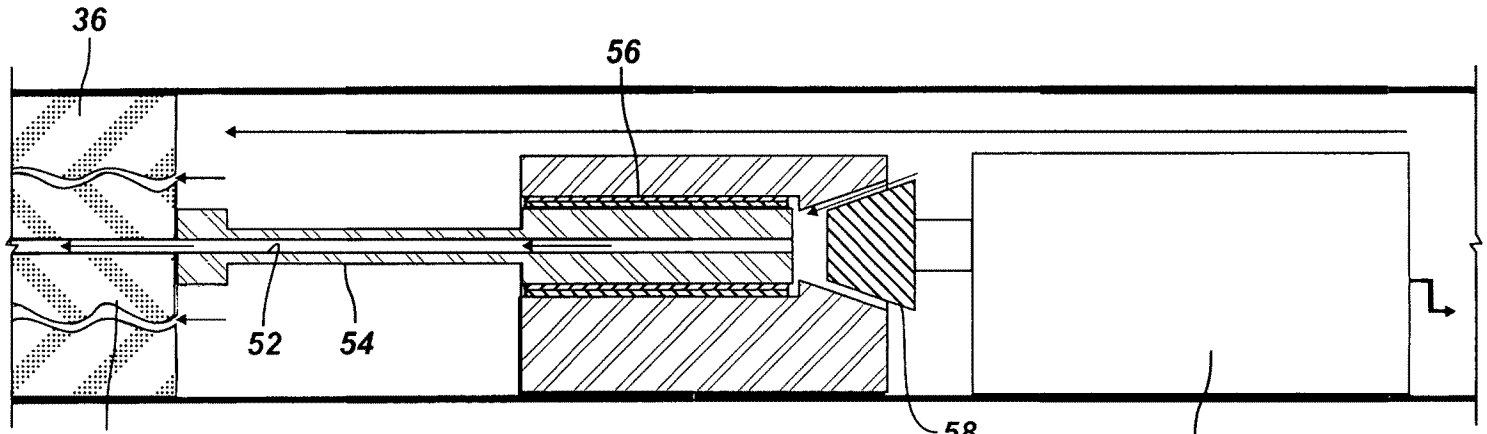
FIG. 11 is a sectional view through the part of the downhole assembly of FIG. 9, with the valve open.

The cylinder 76 has an exhaust port 88, and the piston has a return spring 90, so that when the valve 58 is closed the piston moves to its retracted condition as shown in FIG. 10. However, when the valve 58 is opened the piston 78 is driven to the left as viewed, forcing the collar 70 downwardly and consequently forcing the knuckle joint 80 to rotate clockwise as drawn, which in turn causes the drill bit to deviate the borehole on an upward path.

It will be seen that the exhaust port 88 opens into the downhole assembly, so that the effective pressure differential for this embodiment is $P_1-P_2$, i.e. the same as the pressure drop across the motor 18. If desired, however, the exhaust port can open into the gap between the downhole assembly and the borehole, providing a greater pressure differential.

The invention claimed is:

1. A downhole assembly for connection to a drill string, the downhole assembly comprising a drill bit, a steering mechanism and a motor, the steering mechanism being located between the drill bit and the motor, the motor having a stator and a rotor, the rotor being connected to an output shaft, the output shaft being rotatably mounted in an output shaft bearing block, the rotor being driven to rotate relative to the stator in use by the passage of a drilling fluid along a drilling fluid path between the rotor and the stator, the output shaft bearing block being rigidly mounted and being lubricated in use by some of the drilling fluid which has passed along the drilling fluid path between the stator and the rotor, the motor having a conduit in the rotor and the output shaft through which the drilling fluid can pass, the conduit being separate from the drilling fluid path, the conduit being connected directly to a steering cylinder of the steering mechanism by way of an outlet conduit within the output shaft bearing block, the assembly having a valve to control the flow of drilling fluid through the conduit.

2. The downhole assembly according to claim 1 in which the steering cylinder cooperates with a piston of the steering mechanism.

3. The downhole assembly according to claim 2 having a longitudinal axis, in which the piston is part of a steering mechanism adapted to offset the drill bit from the longitudinal axis.

4. The downhole assembly according to claim 3 in which the piston cooperates with a steering pad which contacts a borehole wall in use.

5. The downhole assembly according to claim 3 in which the piston moves relative to the cylinder in a direction which is substantially perpendicular to the longitudinal axis.

6. The downhole assembly according to claim 3 in which the piston moves relative to the cylinder in a direction which is substantially parallel to the longitudinal axis.

7. The downhole assembly according to claim 6 having cooperating slide elements which are angled relative to the longitudinal axis.

8. The downhole assembly according to claim 2 in which the cylinder has an exhaust for the drilling fluid, the exhaust being located in an outer surface of the steering mechanism.

9. The downhole assembly according to claim 8 in which the exhaust is permanently open, the cross-sectional area of the exhaust being smaller than the minimum cross-sectional area of the conduit and the outlet conduit.

10. The downhole assembly according to claim 1 in which the rotor is also connected to an input shaft, the input shaft being rotatably mounted in an input shaft bearing block, the input shaft bearing block being lubricated in use by some of the drilling fluid prior to passage along the drilling fluid path between the stator and the rotor.

11. The downhole assembly according to claim 10 in which the valve is mounted in the input shaft bearing block.

12. The downhole assembly according to claim 10 in which the input shaft bearing block is rigidly mounted.

13. A method of controlling a part of a downhole assembly connected to a drill string, the downhole assembly including a drill bit, a motor and a steering mechanism, the steering mechanism being located between the drill bit and the motor, the motor having a stator and a rotor, the rotor being connected to an output shaft, the output shaft being rotatably mounted in an output shaft bearing block, the rotor being driven to rotate relative to the stator in use by the passage of a drilling fluid along a drilling fluid path between the rotor and the stator, the output shaft bearing block being rigidly mounted and being lubricated in use by some of the drilling fluid which has passed along the drilling fluid path between the stator and the rotor, the motor having a conduit in the rotor and the output shaft through which the drilling fluid can pass, the conduit being separate from the drilling fluid path, the conduit being connected directly to a steering cylinder of the steering mechanism by way of an outlet conduit within the output shaft bearing block, the steering mechanism rotating with the drill string, the method including the steps of:

controlling the flow of drilling fluid through the conduit by way of a valve;

determining a steering direction for the drill bit, sensing the angular orientation of the steering mechanism, and opening and closing the valve dependent upon the determined steering direction and the sensed angular orientation.

14. The method according to claim 13 in which the valve is opened and closed cyclically in accordance with the rotation of the steering mechanism.

15. The method according to claim 13 including the additional steps of:

{i} determining the angular position diametrically opposed to the steering direction, {ii} opening the valve at a valve opening position before the angular position, and {iii} closing the valve at a valve closing position after the angular position.

16. The method according to claim 13 in which the angle between the valve opening position and the angular position, and the angle between the valve closing position and the angular position, are not equal.

* * * * *